US009646617B2

(12) United States Patent
Jiang et al.

(10) Patent No.: US 9,646,617 B2
(45) Date of Patent: May 9, 2017

(54) METHOD AND DEVICE OF EXTRACTING SOUND SOURCE ACOUSTIC IMAGE BODY IN 3D SPACE

(71) Applicant: SHENZHEN XINYIDAI INSTITUTE OF INFORMATION TECHNOLOGY, Shenzhen, Guangdong (CN)

(72) Inventors: You Jiang, Shenzhen (CN); Liping Huang, Shenzhen (CN); Heng Wang, Shenzhen (CN)

(73) Assignee: SHENZHEN XINYIDAI INSTITUTE OF INFORMATION TECHNOLOGY, Shenzhen. Guangdong (CN)

( * ) Notice: Subject to any disclaimer, the term of this patent is extended or adjusted under 35 U.S.C. 154(b) by 150 days.

(21) Appl. No.: 14/422,070

(22) PCT Filed: Jun. 4, 2014

(86) PCT No.: PCT/CN2014/079177
§ 371 (c)(1),
(2) Date: Feb. 17, 2015

(87) PCT Pub. No.: WO2015/074400
PCT Pub. Date: May 28, 2015

(65) Prior Publication Data

US 2016/0042740 A1 Feb. 11, 2016

(30) Foreign Application Priority Data

Nov. 19, 2013 (CN) ..... 2013 1 0580928

(51) Int. Cl.
*G10L 19/008* (2013.01)
*H04S 3/00* (2006.01)

(52) U.S. Cl.
CPC ..... *G10L 19/008* (2013.01); *H04S 3/002* (2013.01); *H04S 2400/15* (2013.01)

(58) Field of Classification Search
None
See application file for complete search history.

(56) References Cited

U.S. PATENT DOCUMENTS 6,904,152 B1 * 6/2005 Moorer ..... H04S 5/005 381/17
2010/0054483 A1 * 3/2010 Mizuno ..... H04S 7/302 381/17

(Continued)

FOREIGN PATENT DOCUMENTS

CN 102790931 11/2012
CN 102883246 1/2013

(Continued)

OTHER PUBLICATIONS

Hu et al. English translation of CN102883246, Simplifying and laying method for loudspeaker groups of three-dimensional multi-channel audio system. pp. 1-11. Jan. 13, 2013.*

*Primary Examiner* — Curtis Kuntz
*Assistant Examiner* — Qin Zhu
(74) *Attorney, Agent, or Firm* — Hamre, Schumann, Mueller & Larson, P.C.

(57) ABSTRACT

The invention provides a method and device of extracting a sound source acoustic image body in 3D space. The method includes: determining a spatial position of a sound source acoustic image and determining a speaker beside the spatial position where the sound source acoustic image is located according to the determined spatial position (ρ, μ, η) of the sound source acoustic image; calculating a correlation of signals of all sound tracks of the selected speaker in the horizontal direction and the vertical direction, and obtaining and storing a parameter set $\{IC_H, IC_v, Min\{IC_H, IC_v\}\}$ of a (Continued)

acoustic image body, wherein the Min{$IC_H$, $IC_v$} is a smaller value between $IC_H$ and $IC_V$. The expression parameters of the acoustic image body obtained in the present invention are used for providing technical support for accurately restoring the size of the sound source acoustic image in a 3D audio live system, which solves the technical problem that the restored acoustic image in a 3D audio is excessively narrow at present.

2 Claims, 1 Drawing Sheet

(56) References Cited

U.S. PATENT DOCUMENTS

| | | | | |
|---|---|---|---|---|
| 2010/0157726 | A1* | 6/2010 | Ando | H04S 7/308 367/7 |
| 2010/0202629 | A1* | 8/2010 | Takeuchi | H04S 5/00 381/98 |
| 2012/0140931 | A1 | 6/2012 | Shen | |
| 2013/0216070 | A1* | 8/2013 | Keiler | G10L 19/008 381/300 |
| 2013/0259243 | A1* | 10/2013 | Herre | G10L 19/02 381/57 |

FOREIGN PATENT DOCUMENTS

| | | | | |
|---|---|---|---|---|
| CN | 103369453 | | 10/2013 | |
| CN | 103618986 | | 3/2014 | |
| JP | WO 2007083739 | A1 * | 7/2007 | H04S 7/308 |
| WO | 2005/079114 | | 8/2005 | |
| WO | 2009/046460 | | 4/2009 | |

* cited by examiner

METHOD AND DEVICE OF EXTRACTING SOUND SOURCE ACOUSTIC IMAGE BODY IN 3D SPACE

TECHNICAL FIELD

The present invention belongs to the field of acoustics, in particular, relates to a method and device of extracting sound source acoustic image body in 3D space.

BACKGROUND

At the end of 2009, the 3D movie "Avatar" topped the box office in over 30 countries around the world, to early September 2010, the worldwide cumulative box office exceeds 2.7 billion US dollars. "Avatar" has been able to achieve such a brilliant performance at the box office, since it uses the new 3D effects production technologies to provide the shock effect to people's senses. Gorgeous graphics and realistic sound from "Avatar" not only shocked the audience, but also makes the industry have a assertion of "movie into the 3D era". Not only that, it also spawned many more relevant video, recording, playback technologies and standards. In the International Consumer Electronics Show in January 2010 in Las Vegas, color TV giants had flaunted new TV which bring the people new expectations—3D has become a new focus of competition among the global major TV manufacturers. To achieve a better viewing experience, it needs 3D sound field hearing effect synchronized with the content of 3D video, in order to truly achieve an immersive audio-visual experience. Early 3D audio system (for example Ambisonics System), due to its complex structure, has high requirements for the capture and playback devices, and is difficult to be promoted. In recent years, NHK company in Japan launched a 22.2-channel system, which can reproduce the original 3D sound field through 24 speakers. In 2011, MPEG proceed to develop the international standard of the 3D audio, hopes to restore the 3D sound field through less speakers and headphones when reaching a certain coding efficiency, in order to promote the technology to the ordinary households. This shows the 3D audio and video technology has become research focus of the multimedia technology and important direction of further development.

However, the conventional 3D audio only focus on restoring the spatial location or a physical sound field of the sound source, and does not focus on restoring the size of the acoustic image of the sound source, especially the acoustic image body. In order to achieve better sound effect, it needs to restore the size of the acoustic image body accurately, and meanwhile in order to facilitate encoding and decoding and the other system processing, it also need to find the parameters representing sound source acoustic image body, then the original audio and video can be restored perfectly even after processed by the 3D audio system.

SUMMARY

The present invention addresses the deficiencies in the prior art, and proposes a method and device of extracting a sound source acoustic image body in 3D space.

The present invention provide a technical solution of a method of extracting a sound source acoustic image body in 3D space, the method comprises:

Step 1, determining a spatial position of a sound source acoustic image, which is achieved by:

processing time-frequency conversion for a signal of each channel and processing the same sub-band division for each channel; and with the listener as a spherical coordinate system origin, for a speaker with the horizontal angle $\mu_i$ and elevation angle $\eta_i$, setting a vector $p_i(k,n)$ re presenting the time-frequency representation of the corresponding signal, $$p_i(k, n) = g_i(k, n) \cdot \begin{bmatrix} \cos\mu_i \cdot \cos\eta_i \\ \sin\mu_i \cdot \cos\eta_i \\ \sin\eta_i \end{bmatrix}$$

wherein i refers to an index value of the speaker, k refers to a frequency band index, n refers to a time domain frame number index, $g_i(k,n)$ refers to a intensity information of a frequency domain point;

the horizontal angle $\mu_i$ and elevation angle $\eta_i$ is calculated using the following formula, $$\tan\mu(k, n) = \frac{\sum_{i=1}^{N} g_i(k, n) \cdot \cos\mu_i \cdot \cos\eta_i}{\sum_{i=1}^{N} g_i(k, n) \cdot \sin\mu_i \cdot \cos\eta_i}$$

$$\tan\eta(k, n) = \frac{\sqrt{\left[\sum_{i=1}^{N} g_i(k, n) \cdot \cos\mu_i \cdot \cos\eta_i\right]^2 + \left[\sum_{i=1}^{N} g_i(k, n) \cdot \sin\mu_i \cdot \cos\eta_i\right]^2}}{\sum_{i=1}^{N} g_i(k, n) \cdot \sin\eta_i}$$

wherein, N refers to a total number of the speakers, i values for 1, 2 . . . N, μ(k, n), η(k, n) i.e., the horizontal angle μ and elevation angle η of the sound source acoustic image in k-th frequency band of the n-th frame;

a distance ρ from the sound source acoustic image audio to the origin of the spherical coordinate system takes the average distance of distances from all the speakers to the listener;

step 2, determining the speaker beside the spatial position where the sound source acoustic image is located according to the determined spatial position (ρ, μ, η) of the sound source acoustic image;

step 3, calculating a correlation of signals of all sound tracks of the speakers selected at step 2 in the horizontal direction and the vertical direction, which is achieved by:

dividing the selected speakers into left part and right part according to the location of the acoustic image, using the vertical plane of the connecting line between the sound source acoustic image and the listener as a projection plane, calculating a sum of the components of the left and right signals which are perpendicular to the projection plane respectively, denoting the sums as $P_L$ and $P_R$ respectively, and calculating the correlation $IC_H$ of the left and right signals as follows, $$IC_H = \frac{\mathrm{cov}(P_L, P_R)}{\sqrt{\mathrm{cov}(P_L, P_L)} \cdot \sqrt{\mathrm{cov}(P_R, P_R)}}$$

dividing the selected speakers into upper part and lower part according to the location of the acoustic image, using a plane where the sound source acoustic image and the listener are located as a projection plane, calculating a sum of the components of the upper and lower signals which are perpendicular to the projection plane respectively, denoting the sums as $P_U$ and $P_D$ respectively, and calculating the correlation $IC_V$ of the upper and lower signals as follows, $$IC_V = \frac{\mathrm{cov}(P_U, P_D)}{\sqrt{\mathrm{cov}(P_U, P_U)} \cdot \sqrt{\mathrm{cov}(P_D, P_D)}}$$

step 4, obtaining and storing a parameter set $\{IC_H, IC_v, \mathrm{Min}\{IC_H, IC_v\}\}$ of the acoustic image body, wherein the $\mathrm{Min}\{IC_H, IC_v\}$ is a smaller value between ICH and ICv.

The present invention also provides a device of extracting a sound source acoustic image body in 3D space, the device comprises:

a spatial position extraction unit, configured to determine a spatial position of the sound source acoustic image by:

processing time-frequency conversion for a signal of each channel and processing the same sub-band division for each channel; and with the listener as a spherical coordinate system origin, for a Speaker located in the horizontal angle $\mu_i$ and elevation angle $\eta_i$, setting a vector $p_i(k,n)$ representing the time-frequency representation of the corresponding signal, $$p_i(k, n) = g_i(k, n) \cdot \begin{bmatrix} \cos\mu_i \cdot \cos\eta_i \\ \sin\mu_i \cdot \cos\eta_i \\ \sin\eta_i \end{bmatrix}$$

wherein i refers to an index value of the speaker, k refers to a frequency band index, n refers to a time domain frame number index, $g_i(k,n)$ refers to a intensity information of a frequency domain point;

the horizontal angle $\mu_i$ and elevation angle $\eta_i$ is calculated using the following formula, $$\tan\mu(k, n) = \frac{\sum_{i=1}^{N} g_i(k, n) \cdot \cos\mu_i \cdot \cos\eta_i}{\sum_{i=1}^{N} g_i(k, n) \cdot \sin\mu_i \cdot \cos\eta_i}$$

$$\tan\eta(k, n) = \frac{\sqrt{\left[\sum_{i=1}^{N} g_i(k, n) \cdot \cos\mu_i \cdot \cos\eta_i\right]^2 + \left[\sum_{i=1}^{N} g_i(k, n) \cdot \sin\mu_i \cdot \cos\eta_i\right]^2}}{\sum_{i=1}^{N} g_i(k, n) \cdot \sin\eta_i}$$

wherein, N refers to a total number of the speakers, i values for 1, 2 . . . N, $\mu(k, n)$, $\eta(k, n)$ i.e., the horizontal angle $\mu$ and elevation angle $\eta$ of the sound source acoustic image in k-th frequency band of the n-th frame;

a distance $\rho$ from the sound source acoustic image audio to the origin of the spherical coordinate system takes the average distance of distances from all the speakers to the listener;

a speaker selecting unit, configured to determine the speaker beside the spatial position where the sound source acoustic image is located according to the determined spatial position ($\rho$, $\mu$, $\eta$) of the sound source acoustic image;

a correlation extraction unit configured calculate a correlation of signals of all sound tracks of the speakers selected by the speaker selecting unit in the horizontal direction and the vertical direction, which is achieved by:

dividing the selected speakers into left part and right part according to the location of the acoustic image, using the vertical plane of the connecting line between the sound source acoustic image and the listener as a projection plane, calculating a sum of the components of the left and right signals which are perpendicular to the projection plane respectively, denoting the sums as $P_L$ and $P_R$ respectively, and calculating the correlation $IC_H$ of the left and right signals as follows, $$IC_H = \frac{\mathrm{cov}(P_L, P_R)}{\sqrt{\mathrm{cov}(P_L, P_L)} \cdot \sqrt{\mathrm{cov}(P_R, P_R)}}$$

dividing the selected speakers into upper part and lower part according to the location of the acoustic image, using the vertical plane of the connecting line between the sound source acoustic image and the listener as a projection plane, calculating a sum of the components of the upper and lower signals which are perpendicular to the projection plane respectively, denoting the sums as $P_U$ and $P_D$ respectively, and calculating the correlation $IC_V$ of the upper and lower signals as follows, $$IC_V = \frac{\mathrm{cov}(P_U, P_D)}{\sqrt{\mathrm{cov}(P_U, P_U)} \cdot \sqrt{\mathrm{cov}(P_D, P_D)}}$$

a acoustic image body characteristic storage unit, configured to obtain and store a parameter set $\{IC_H, IC_v, \mathrm{Min}\{IC_H, IC_v\}\}$ of the acoustic image body, wherein the $\mathrm{Min}\{IC_H, IC_v\}$ is a smaller value between $IC_H$ and $IC_v$.

The sound source acoustic image body refers to the sizes of the depth, length and height of the acoustic image in three dimensions relative to the listener. The present invention is directed to a multi-channel 3D audio system, and describes the size of the sound source acoustic image body by using correlations between different sound channels in three dimensions. The expression parameters of the acoustic image body obtained in the present invention are used for providing technical support for accurately restoring the size of the sound source acoustic image in a 3D audio live system, which solves the technical problem that the restored acoustic image in a 3D audio is excessively narrow at present.

DETAILED DESCRIPTION

Figure 1:
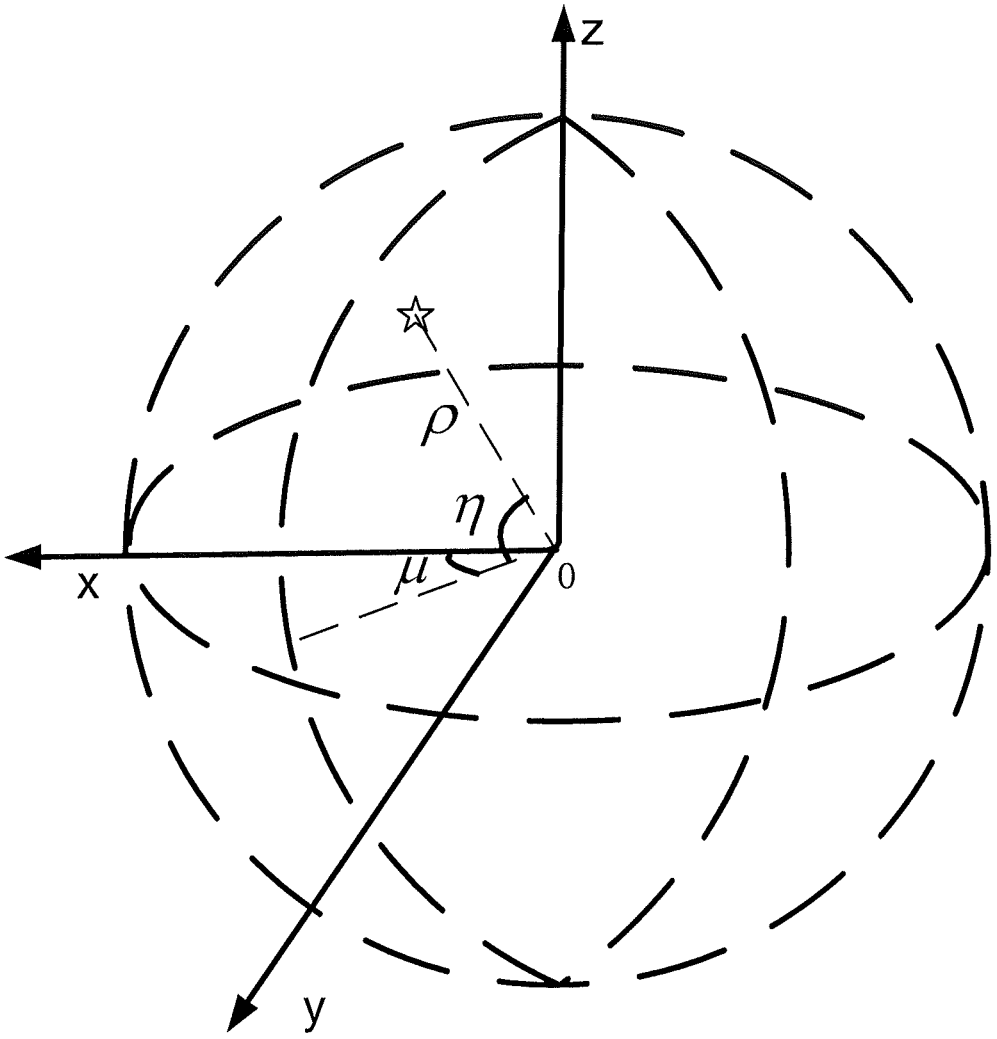
FIG. 1 is the calculation relationship between the speaker location and the signal in an embodiment of the present invention.

The present invention is further described in the follow with reference to the drawings and the embodiments.

The skilled person in the art use the computer-based software technology to run the procedure of the technical solution of the present invention automatically. The procedure of the embodiment comprises:

step 1, determining a spatial position of a sound source acoustic image, wherein with the listener as a spherical coordinate system origin, spherical coordinate of the speaker can be set as (ρ, μ, η), ρ is the distance from the speaker to the origin of the spherical coordinate system, μ is the horizontal angle and η is elevation angle, as shown in FIG. 1.

Wherein, with the listener as a reference point, orthogonal decomposition is implemented for each channel signal in the multi-channel system, to obtain the components on X, Y and Z axes of each sound channel in a 3D Cartesian coordinate system. The component of each sound channel is the decomposition of the original mono source on the sound channel. Thus after obtaining components of each channel on X, Y and Z axes, every components on X, Y and Z axes are added respectively, and the components of the original mono source with respective to the position of the listener are obtained. The embodiment is achieved by:

processing time-frequency conversion for a signal of each channel and processing the same sub-band division for each channel, wherein the time-frequency conversion and sub-band division are implemented through the prior art.

As there are many speakers, spherical coordinate of each speaker (ρ, μ, η) is denoted by ($\rho_i$, $\mu_i$, $\eta_i$) by using the index value as the subscript. For the speaker with the horizontal angle $\mu_i$ and elevation angle $\eta_i$, a vector $p_i(k,n)$ may be used to represent the time-frequency representation of the corresponding signal, the calculation formula of $p_i(k,n)$ is shown in formula (1):

$$p_i(k, n) = g_i(k, n) \cdot \begin{bmatrix} \cos\mu_i \cdot \cos\eta_i \\ \sin\mu_i \cdot \cos\eta_i \\ \sin\eta_i \end{bmatrix} \tag{1}$$

wherein i refers to an index value of the speaker, k refers to a frequency band index, n refers to a time domain frame number index, $g_i(k,n)$ refers to a intensity information of a frequency domain point. The azimuth angle of the sound source acoustic image can be divided into horizontal angle μ and elevation angle η and can be calculated by formula (2) and (3):

$$\tan\mu(k, n) = \frac{\sum_{i=1}^{N} g_i(k, n) \cdot \cos\mu_i \cdot \cos\eta_i}{\sum_{i=1}^{N} g_i(k, n) \cdot \sin\mu_i \cdot \cos\eta_i} \tag{2}$$

$$\tan\eta(k, n) = \frac{\sqrt{\left[\sum_{i=1}^{N} g_i(k, n) \cdot \cos\mu_i \cdot \cos\eta_i\right]^2 + \left[\sum_{i=1}^{N} g_i(k, n) \cdot \sin\mu_i \cdot \cos\eta_i\right]^2}}{\sum_{i=1}^{N} g_i(k, n) \cdot \sin\eta_i} \tag{3}$$

wherein, N refers to a total number of the speakers, i values for 1, 2 . . . N, μ(k, n), η(k, n) i.e., the horizontal angle μ and elevation angle η of the sound source acoustic image in k-th frequency band of the n-th frame;

Thus the horizontal angle μ and elevation angle η of the sound source acoustic image may be obtained, because the speakers are distributed with the listener as the center, a distance ρ from the sound source acoustic image audio to the origin of the spherical coordinate system takes the average distance of distances from all the speakers to the listener, typically, ρ=ρ1=ρ2= . . . =ρN.

step 2, determining the speaker beside the spatial position where the sound source acoustic image is located.

After the spatial position (ρ, μ, η) for restoring the sound source acoustic image is determined, the speaker beside the sound source acoustic image is found according to the position of the sound source acoustic image.

In specific implementation, the speakers are ordered from proximal to distal according to the distance from each speaker ($\rho_i$, $\mu_i$, $\eta_i$) to the sound source acoustic image, then the nearest speakers are selected. The speakers are selected flexibly according to the actual situation, and it is generally advisable to select 4-8 speakers.

step 3, calculating a correlation of signals of all sound tracks of the speakers selected at step 2 in the horizontal direction and the vertical direction, wherein the correlation indicates the size of acoustic image in the horizontal and vertical directions.

the selected speakers is divided into left part and right part according to the location of the acoustic image, by setting $P_i$ as the frequency domain value of the i-th channel of the sound source and using the vertical plane of the connecting line between the sound source acoustic image and the listener as a projection plane, a sum of the components of the left and right signals which are perpendicular to the projection plane is calculated respectively, and the sums are denoted as $P_L$ and $P_R$ respectively. That is, all speakers selected at step 2 on the left side of the acoustic image are selected to obtain the components of the corresponding frequency domain values for each speaker $P_i$, which are respectively perpendicular to the plane of projection, and then the components are summed to obtain $P_L$; all speakers selected at step 2 on the right side of the acoustic image are selected to obtain the components of the corresponding frequency domain values for each speaker $P_i$, which are respectively perpendicular to the plane of projection, and then the components are summed to obtain $P_R$. And the correlation $IC_H$ of the left and right signals is calculated, as shown in formula (4):

$$IC_H = \frac{\mathrm{cov}(P_L, P_R)}{\sqrt{\mathrm{cov}(P_L, P_L)} \cdot \sqrt{\mathrm{cov}(P_R, P_R)}} \tag{4}$$

Similarly, the selected speakers are divided into upper part and lower part according to the location of the acoustic image, by using the plane where the sound source acoustic image and the listener are located and which is perpendicular to the vertical plane mentioned above as a projection plane, a sum of the components of the upper and lower signals which are perpendicular to the projection plane is calculated respectively, and the sums are denoted as $P_U$ and $P_D$ respectively. That is, all speakers selected at step 2 on the upper side of the acoustic image are selected to obtain the components of the corresponding frequency domain values for each speaker $P_i$, which are respectively perpendicular to the plane of projection, and then the components are summed to obtain $P_U$; all speakers selected at step 2 on the lower side of the acoustic image are selected to obtain the components of the corresponding frequency domain values for each speaker $P_i$, which are respectively perpendicular to the plane of projection, and then the components are summed to obtain $P_D$. And the correlation $IC_V$ of the upper and lower signals is calculated, as shown in formula (5):

$$IC_V = \frac{\mathrm{cov}(P_U, P_D)}{\sqrt{\mathrm{cov}(P_U, P_U)} \cdot \sqrt{\mathrm{cov}(P_D, P_D)}} \tag{5}$$

Thus parameters indicative of the size of the acoustic image in the horizontal and vertical directions may be obtained, because People's perception of distance is not sensitive enough, the distance parameter may be represented by the smaller value between $IC_H$ and $IC_v$, namely $\mathrm{Min}\{IC_H, IC_v\}$.

According to the above method, according to the horizontal angle μ and elevation angle η of each band of signal of each frame, the acoustic image body of each band of signal of each frame is obtained accordingly.

In specific implementation, the extracted acoustic image body may be represented by a parameter set $\{IC_H, IC_v, \mathrm{Min}\{IC_H, IC_v\}\}$ and may be stored, to restore the sound source acoustic image.

The technical solution of the present invention may be applied with the software modular technology, to implement as a device. The embodiment of the present invention accordingly provides a device of extracting a sound source acoustic image body in 3D space, the device comprises:

a spatial position extraction unit, configured to determine a spatial position of the sound source acoustic image by:

processing time-frequency conversion for a signal of each channel and processing the same sub-band division for each channel; and with the listener as a spherical coordinate system origin, for a speaker with the horizontal angle $\mu_i$ and elevation angle $\eta_i$, setting a vector $p_i(k,n)$ re presenting the time-frequency representation of the corresponding signal, $$p_i(k, n) = g_i(k, n) \cdot \begin{bmatrix} \cos\mu_i \cdot \cos\eta_i \\ \sin\mu_i \cdot \cos\eta_i \\ \sin\eta_i \end{bmatrix}$$

wherein i refers to an index value of the speaker, k refers to a frequency band index, n refers to a time domain frame number index, $g_i(k,n)$ refers to a intensity information of a frequency domain point;

the horizontal angle $\mu_i$ and elevation angle $\eta_i$ is calculated using the following formula, $$\tan\mu(k, n) = \frac{\sum_{i=1}^{N} g_i(k, n) \cdot \cos\mu_i \cdot \cos\eta_i}{\sum_{i=1}^{N} g_i(k, n) \cdot \sin\mu_i \cdot \cos\eta_i}$$

$$\tan\eta(k, n) = \frac{\sqrt{\left[\sum_{i=1}^{N} g_i(k, n) \cdot \cos\mu_i \cdot \cos\eta_i\right]^2 + \left[\sum_{i=1}^{N} g_i(k, n) \cdot \sin\mu_i \cdot \cos\eta_i\right]^2}}{\sum_{i=1}^{N} g_i(k, n) \cdot \sin\eta_i}$$

wherein, N refers to a total number of the speakers, i values for 1, 2 . . . N, μ(k, n), η(k, n) i.e., the horizontal angle μ and elevation angle η of the sound source acoustic image in k-th frequency band of the n-th frame;

a distance ρ from the sound source acoustic image audio to the origin of the spherical coordinate system takes the average distance of distances from all the speakers to the listener;

a speaker selecting unit, configured to determine the speaker beside the spatial position where the sound source acoustic image is located according to the determined spatial position (ρ, μ, η) of the sound source acoustic image;

a correlation extraction unit configured calculate a correlation of signals of all sound tracks of the speakers selected by the speaker selecting unit in the horizontal direction and the vertical direction, which is achieved by:

dividing the selected speakers into left part and right part according to the location of the acoustic image, using the vertical plane of the connecting line between the sound source acoustic image and the listener as a projection plane, calculating a sum of the components of the left and right signals which are perpendicular to the projection plane respectively, denoting the sums as $P_L$ and $P_R$ respectively, and calculating the correlation $IC_H$ of the left and right signals as follows, $$IC_H = \frac{\mathrm{cov}(P_L, P_R)}{\sqrt{\mathrm{cov}(P_L, P_L)} \cdot \sqrt{\mathrm{cov}(P_R, P_R)}}$$

dividing the selected speakers into upper part and lower part according to the location of the acoustic image, using a plane where the sound source acoustic image and the listener are located as a projection plane, calculating a sum of the components of the upper and lower signals which are perpendicular to the projection plane respectively, denoting the sums as $P_U$ and $P_D$ respectively, and calculating the correlation $IC_V$ of the upper and lower signals as follows, $$IC_V = \frac{\mathrm{cov}(P_U, P_D)}{\sqrt{\mathrm{cov}(P_U, P_U)} \cdot \sqrt{\mathrm{cov}(P_D, P_D)}}$$

a acoustic image body characteristic storage unit, configured to obtain and store a parameter set $\{IC_H, IC_v, \mathrm{Min}\{IC_H, IC_v\}\}$ of the acoustic image body, wherein the $\mathrm{Min}\{IC_H, IC_v\}$ is a smaller value between $IC_H$ and $IC_v$, $IC_H$, $IC_v$, $\mathrm{Min}\{IC_H, IC_v\}$ are used to identify the characteristic of the depth, length and height of the acoustic image in three dimensions respectively.

The above-described examples of the present invention is merely to illustrate the implementation of method of the present invention, within the technical scope disclosed in the present invention, any person skilled in the art can easily think of the changes and alterations, and the scope of the invention should be covered by the protection scope defined by the appended claims.

What is claimed is:

1. A method of extracting a sound source acoustic image body in 3D space, the method comprising:

step 1, determining a spatial position of a sound source acoustic image, which is achieved by:

processing time-frequency conversion for a signal of each channel and processing the same sub-band division for each channel by a microprocessor; and with the listener as a spherical coordinate system origin, for a speaker with the horizontal angle $\mu_i$ and elevation angle $\eta_i$, setting a vector $p_i(k,n)$ representing the time-frequency representation of the corresponding signal, $$p_i(k,n) = g_i(k,n) \cdot \begin{bmatrix} \cos\mu_i \cdot \cos\eta_i \\ \sin\mu_i \cdot \cos\eta_i \\ \sin\eta_i \end{bmatrix}$$

wherein i refers to an index value of the speaker, k refers to a frequency band index, n refers to a time domain frame number index, $g_i(k,n)$ refers to a intensity information of a frequency domain point;

the horizontal angle $\mu_i$ and elevation angle $\eta_i$ is calculated using the following formula, $$\tan\mu(k,n) = \frac{\sum_{i=1}^{N} g_i(k,n) \cdot \cos\mu_i \cdot \cos\eta_i}{\sum_{i=1}^{N} g_i(k,n) \cdot \sin\mu_i \cdot \cos\eta_i}$$

$$\tan\eta(k,n) = \frac{\sqrt{\left[\sum_{i=1}^{N} g_i(k,n) \cdot \cos\mu_i \cdot \cos\eta_i\right]^2 + \left[\sum_{i=1}^{N} g_i(k,n) \cdot \sin\mu_i \cdot \cos\eta_i\right]^2}}{\sum_{i=1}^{N} g_i(k,n) \cdot \sin\eta_i}$$

wherein, N refers to a total number of the speakers, i values for 1, 2 . . . N, $\mu(k, n)$, $\eta(k, n)$ i.e., the horizontal angle $\mu$ and elevation angle $\eta$ of the sound source acoustic image in k-th frequency band of the n-th frame;

a distance $\rho$ from the sound source acoustic image audio to the origin of the spherical coordinate system takes the average distance of distances from all the speakers to the listener;

step 2, determining the speaker beside the spatial position by a microprocessor where the sound source acoustic image is located according to the determined spatial position ($\rho$, $\mu$, $\eta$) of the sound source acoustic image;

step 3, calculating a correlation of signals of all sound tracks of the speakers selected at step 2 in the horizontal direction and the vertical direction by a microprocessor, which is achieved by:

dividing the selected speakers into left part and right part according to the location of the acoustic image, using a vertical plane of the connecting line between the sound source acoustic image and the listener as a projection plane, calculating a sum of the components of the left and right signals which are perpendicular to the projection plane respectively, denoting the sums as $P_L$ and $P_R$ respectively, and calculating the correlation $IC_H$ of the left and right signals as follows, $$IC_H = \frac{\mathrm{cov}(P_L, P_R)}{\sqrt{\mathrm{cov}(P_L, P_L)} \cdot \sqrt{\mathrm{cov}(P_R, P_R)}}$$

dividing the selected speakers into upper part and lower part according to the location of the acoustic image, using a horizontal plane where the sound source acoustic image and the listener are located as a projection plane, calculating a sum of the components of the upper and lower signals which are perpendicular to the projection plane respectively, denoting the sums as $P_U$ and $P_D$ respectively, and calculating the correlation $IC_V$ of the upper and lower signals as follows, $$IC_V = \frac{\mathrm{cov}(P_U, P_D)}{\sqrt{\mathrm{cov}(P_U, P_U)} \cdot \sqrt{\mathrm{cov}(P_D, P_D)}}$$

step 4, obtaining and storing a parameter set $\{IC_H, IC_v, \mathrm{Min}\{IC_H, IC_v\}\}$ of the acoustic image body in a storage medium, wherein the $\mathrm{Min}\{IC_H, IC_v\}$ is a smaller value between $IC_H$ and $IC_v$.

2. A device of extracting a sound source acoustic image body in 3D space, the device comprising:

a spatial position extraction unit having a microprocessor, the spatial position extraction unit being configured to determine a spatial position of the sound source acoustic image by:

processing time-frequency conversion for a signal of each channel and processing the same sub-band division for each channel by the microprocessor; and with the listener as a spherical coordinate system origin, for a speaker with the horizontal angle $\mu_i$ and elevation angle $\eta_i$, setting a vector $p_i(k,n)$ representing the time-frequency representation of the corresponding signal, $$p_i(k,n) = g_i(k,n) \cdot \begin{bmatrix} \cos\mu_i \cdot \cos\eta_i \\ \sin\mu_i \cdot \cos\eta_i \\ \sin\eta_i \end{bmatrix}$$

wherein i refers to an index value of the speaker, k refers to a frequency band index, n refers to a time domain frame number index, $g_i(k,n)$ refers to a intensity information of a frequency domain point;

the horizontal angle $\mu_i$ and elevation angle $\eta_i$ is calculated using the following formula, $$\tan\mu(k,n) = \frac{\sum_{i=1}^{N} g_i(k,n) \cdot \cos\mu_i \cdot \cos\eta_i}{\sum_{i=1}^{N} g_i(k,n) \cdot \sin\mu_i \cdot \cos\eta_i}$$

$$\tan\eta(k,n) = \frac{\sqrt{\left[\sum_{i=1}^{N} g_i(k,n) \cdot \cos\mu_i \cdot \cos\eta_i\right]^2 + \left[\sum_{i=1}^{N} g_i(k,n) \cdot \sin\mu_i \cdot \cos\eta_i\right]^2}}{\sum_{i=1}^{N} g_i(k,n) \cdot \sin\eta_i}$$

wherein, N refers to a total number of the speakers, i values for 1, 2 . . . N, μ(k, n), η(k, n) i.e., the horizontal angle μ and elevation angle η of the sound source acoustic image in k-th frequency band of the n-th frame;

a distance ρ from the sound source acoustic image audio to the origin of the spherical coordinate system takes the average distance of distances from all the speakers to the listener;

a speaker selecting unit having a microprocessor, the speaker selecting unit being configured to determine the speaker beside the spatial position where the sound source acoustic image is located according to the determined spatial position (ρ, μ, η) of the sound source acoustic image;

a correlation extraction unit having a microprocessor, the correlation extraction unit being configured calculate a correlation of signals of all sound tracks of the speakers selected by the speaker selecting unit in the horizontal direction and the vertical direction, which is achieved by:

dividing the selected speakers into left part and right part according to the location of the acoustic image, using a vertical plane of the connecting line between the sound source acoustic image and the listener as a projection plane, calculating a sum of the components of the left and right signals which are perpendicular to the projection plane respectively, denoting the sums as $P_L$ and $P_R$ respectively, and calculating the correlation $IC_H$ of the left and right signals as follows, $$IC_H = \frac{\mathrm{cov}(P_L, P_R)}{\sqrt{\mathrm{cov}(P_L, P_L)} \cdot \sqrt{\mathrm{cov}(P_R, P_R)}}$$

dividing the selected speakers into upper part and lower part according to the location of the acoustic image, using a horizontal plane where the sound source acoustic image and the listener are located as a projection plane, calculating a sum of the components of the upper and lower signals which are perpendicular to the projection plane respectively, denoting the sums as $P_U$ and $P_D$ respectively, and calculating the correlation $IC_V$ of the upper and lower signals as follows, $$IC_V = \frac{\mathrm{cov}(P_U, P_D)}{\sqrt{\mathrm{cov}(P_U, P_U)} \cdot \sqrt{\mathrm{cov}(P_D, P_D)}}$$

an acoustic image body characteristic storage unit having a storage medium, the acoustic image body being configured to obtain and store a parameter set $\{IC_H, IC_v, \mathrm{Min}\{IC_H, IC_v\}\}$ of the acoustic image body, wherein the $\mathrm{Min}\{IC_H, IC_v\}$ is a smaller value between $IC_H$ and $IC_v$.

* * * * *